United States Patent [19]

Hirahara

[11] 4,352,553

[45] Oct. 5, 1982

[54] QUALITY CONTROL COPYING APPARATUS

[75] Inventor: Shuzo Hirahara, Yokohama, Japan

[73] Assignee: Tokyo Shibaura Denki Kabushiki Kaisha, Kanagawa, Japan

[21] Appl. No.: 216,767

[22] Filed: Dec. 15, 1980

[30] Foreign Application Priority Data

Dec. 24, 1979 [JP] Japan ..... 54-166816

[51] Int. Cl.[3] ..... G03G 15/00

[52] U.S. Cl. ..... 355/14 E; 355/8; 355/14 R; 355/68; 118/647; 250/204; 250/205; 250/565

[58] Field of Search ..... 355/14 R, 14 E, 8, 35, 355/67, 68, 69, 70; 118/647, 624; 250/201, 202, 204, 205, 564, 565

[56] References Cited

U.S. PATENT DOCUMENTS

| | | | |
|---|---|---|---|
| 2,956,487 | 10/1960 | Giaimo . | |
| 3,926,518 | 12/1975 | Berry et al. | 355/14 E X |
| 4,017,180 | 4/1977 | Yen et al. | 355/68 |
| 4,093,376 | 6/1978 | Rabindran | 250/205 X |
| 4,101,216 | 7/1978 | Grossmann | 355/35 |
| 4,124,295 | 11/1978 | Gardiner | 355/68 |
| 4,153,364 | 5/1979 | Suzuki et al. | 355/14 E |
| 4,176,943 | 12/1979 | Hasebe | 355/14 R |
| 4,200,391 | 4/1980 | Sakamoto et al. | 355/68 X |
| 4,239,374 | 12/1980 | Tatsumi et al. | 355/14 E |
| 4,256,401 | 3/1981 | Fujimura et al. | 355/67 X |
| 4,277,162 | 7/1981 | Kasahara et al. | 355/14 R |
| 4,319,830 | 3/1982 | Roach | 355/68 X |

*Primary Examiner*—Arthur C. Prescott

*Attorney, Agent, or Firm*—Schuyler, Banner, Birch, McKie & Beckett

[57] ABSTRACT

The present invention concerns copying apparatus which automatically controls the quality of copies. The copying apparatus includes a density detector for detecting the frequency of occurrence of density values along a scanning line of a document to be copied, i.e., the frequency distribution of density values is determined. When the frequency distribution has at least three maxima, a smoothing device smooths the frequency distribution via a predetermined filter function till the frequency distribution has one or two maxima. In the event the frequency distribution has one or two maxima, a density detecting device detects at least one density value according to a maximum or minimum value of the frequency distribution. A control device then controls the copy quality of a reproduced image according to the density value.

18 Claims, 12 Drawing Figures

BIAS CONTROL CIRCUIT
DC-DC CONVERTER
PROCESSING CIRCUIT
ROM 1
ROM 2
CPU
RAM
EXPOSURE CONTROL DEVICE
DENSITY DETECTOR
ABC
XYZ
F(L)
log L
log Lc
F1
F2

QUALITY CONTROL COPYING APPARATUS

BACKGROUND OF THE INVENTION

This invention relates to copying apparatus which automatically controls the copy quality according to the density of copied documents.

In conventional copying apparatus, an operator operates a dial or lever, or selects one of several copy buttons according to the nature of a copied document. This usually adjusts the exposure time of the photosensitive material, or adjusts a bias voltage value of a developing device to obtain a good copy. However, this type of apparatus requires manual operation of the dial or lever, or selection of a button according to the density of the document, in addition to manually pressing the copy start button. Furthermore, the above apparatus has a disadvantage in that copies of poor quality sometimes result, due to the visual perception of the operator. Therefore, copying apparatus in which the density of a document is detected and automatically used to adjust the exposure time or the bias voltage of the developing device have recently been developed.

In the latter copying apparatus, there are several methods for detecting density, such as shown in Japanese patent disclosures Nos. 53-93834, 53-93835, 53-93836. One method is to detect minimum density (and/or maximum density) of a document by detecting the light reflected from the document. However, this method is vulnerable to electrical noises or mechanical vibrations. Although copies having high picture quality generally can be obtained by the above method because the darkest and lightest parts are detected, it is often difficult to obtain high quality copies because true density values are not detected, even if the minimum density is above a predetermined density value.

Another known method determines the density of a document by detecting the light reflected from the document to control copy quality. However, the disadvantage of this method is that the control signal changes in response to the ratio of the area of the dark or black part to the light or white part even if density values in the black part and white part are the same in two documents.

SUMMARY OF THE INVENTION

It is one object of this invention to provide an automatic quality control apparatus which can always obtain copies having high quality for all types of documents.

According to this invention, the foregoing and other objects are attained by an automatic quality control copying apparatus which detects the frequency distribution of the density of a document to be copied. The apparatus includes a frequency detector for detecting the frequency distribution of the density of a document. The term frequency distribution means the density values of the document along a scanning line versus the frequency of occurence of the density values. The apparatus further includes a smoothing device for smoothing the frequency distribution in the event the frequency distribution has at least three maxima. A predetermined filter smooths the frequency distribution to reduce the number of maxima to one or two. In the event the frequency distribution has one or two maxima, a density detector means is also provided for detecting at least one maximum and minimum density value. Finally, a control device is provided for controlling the quality of a reproduction image according to the density value.

BRIEF DESCRIPTION OF THE DRAWINGS

Other objects and features of the invention will become apparent to those skilled in the art as the disclosure is made in the following description of a preferred embodiment of the invention, as illustrated in the accompanying sheet of drawings, in which.

DESCRIPTION OF THE PREFERRED EMBODIMENTS

Figure 1:
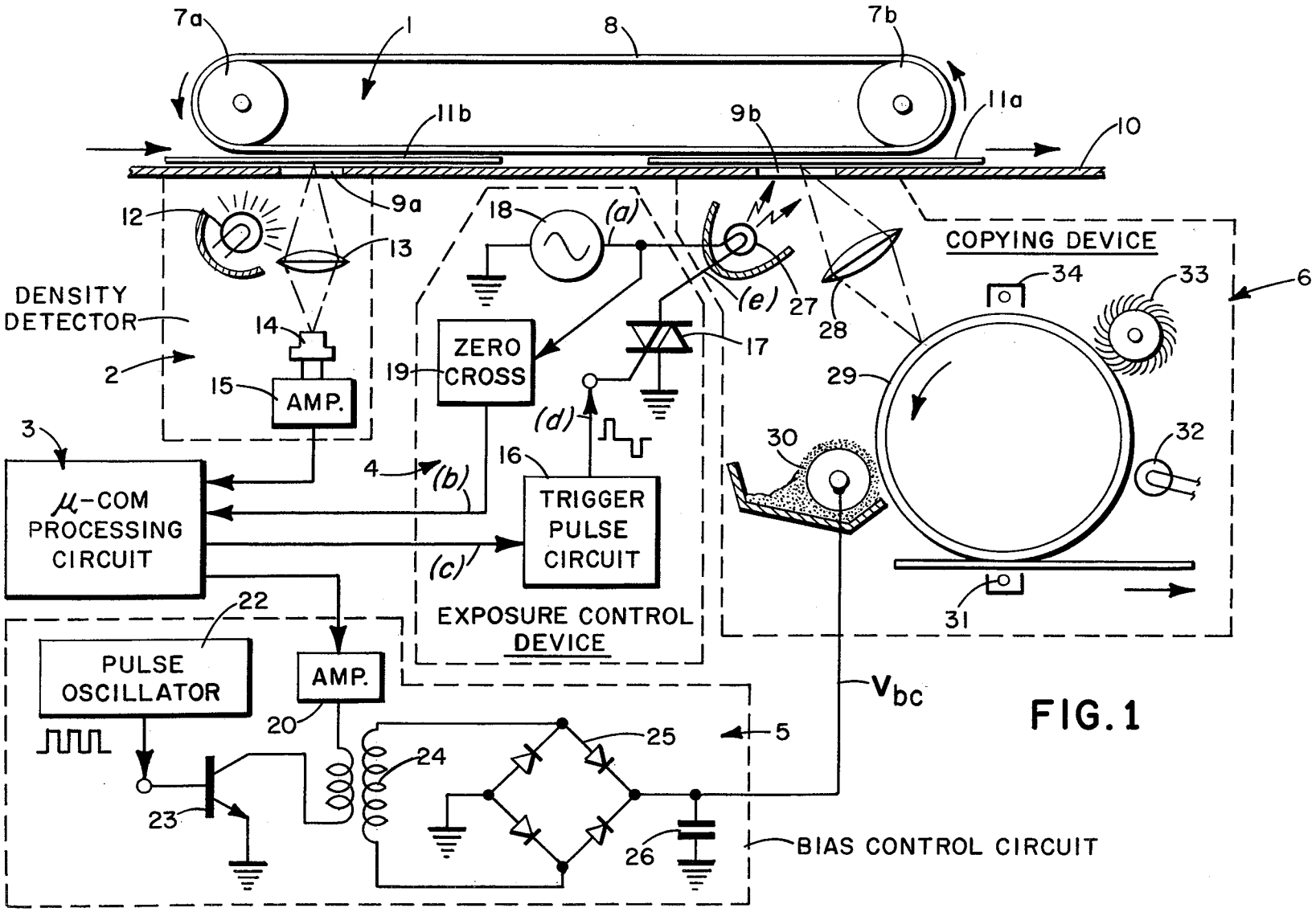
FIG. 1 shows a schematic view of one embodiment of the invention.

One preferred embodiment of this invention will first be explained by reference to FIG. 1 which shows the entire structure. The automatic quality control copying apparatus comprises a scanning device 1 for scanning a document to be copied, a density detector 2 for obtaining density information by light reflected from the document, a processing circuit 3 for processing the density information (electrical signals from the reflected light) and generating control signals for the exposure time and bias voltage of a developing device, an exposure control device 4 for controlling the exposure time according to the control signals, a bias control circuit 5 for controlling bias voltage and a copying device 6 for actually copying by electrophotography.

Scanning device 1 has an endless belt 8 bound between two rollers 7*a*, 7*b*, and a supporter 10 have two slits 9*a* and 9*b*. The document is scanned along a scanning line through slit 9*a*, which may be a small circular slit located near the center of the document. Documents 11*a* and 11*b* are sandwiched between belt 8 and supporter 10 and carried in the direction of the arrow. Density detector 2 comprises a detecting lamp 12 for irradiating document 11*b* through slit 9*a*, a lens 13 for concentrating light reflected from document 11 through slit 9*a*, a photodiode 14 for receiving concentrated light, and an amplifier 15 for amplifying reflecting signals converted by photodiode 14.

Figures 2, 8B:
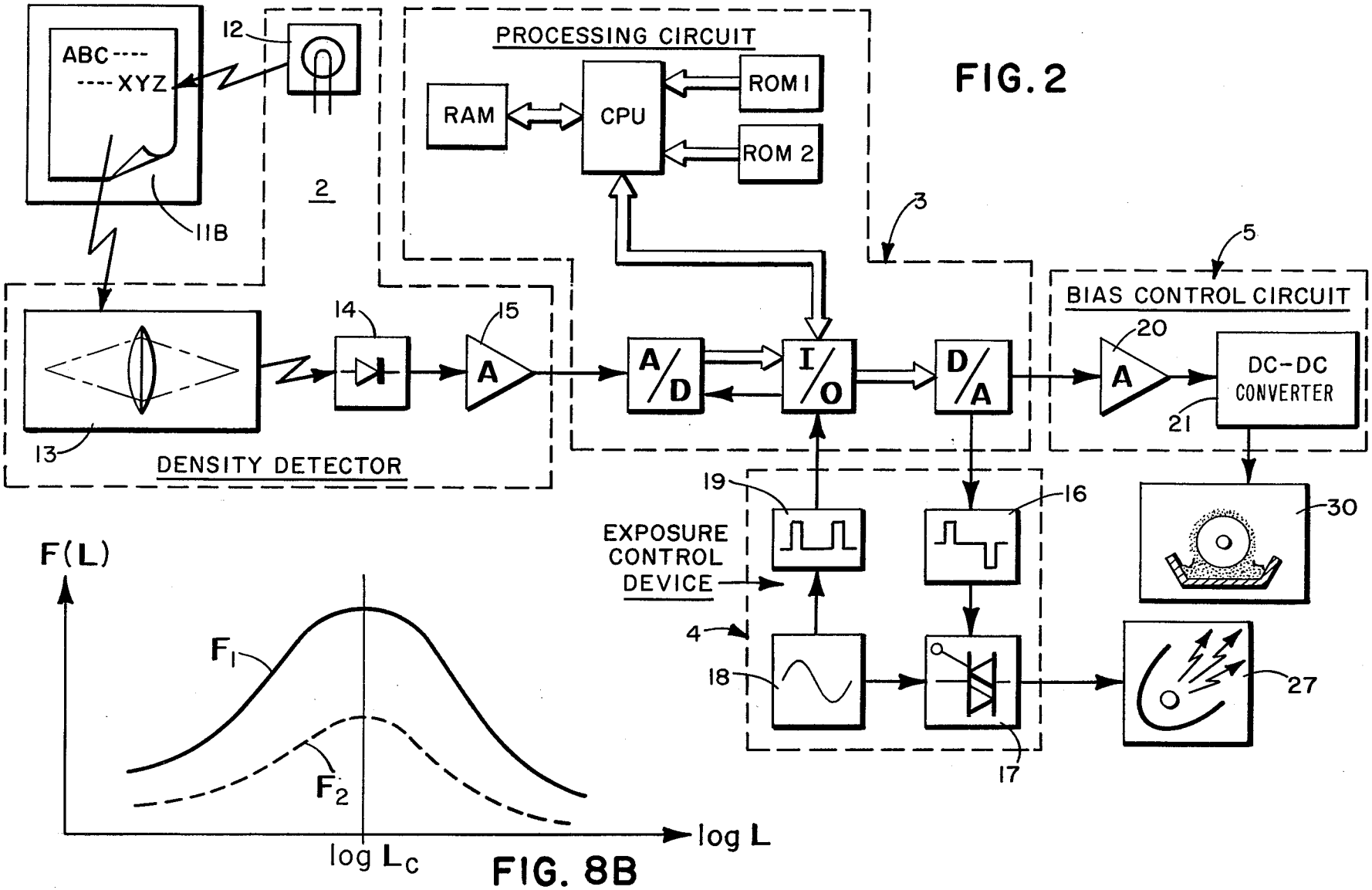
FIG. 2 shows another schematic view of the embodiment shown in FIG. 1.
FIG. 8B is a graph showing two contrast functions F1 and F2.

Processing circuit 3 comprises a central processing unit (CPU), a random access memory (RAM), two read only memories (ROM1 and ROM2), an interface circuit (IO), an analog-digital converter (AD), and a digital-analog converter (DA) as shown in FIG. 2. Exposure control device 4 comprises a trigger pulse circuit 16 for receiving control signals to control the exposure time from interface circuit IO, a bidirectional thyristor 17 triggered by the trigger pulses, a.c. power source 18 and zero-crossing detector 19.

Bias control circuit 5 comprises an amplifier 20 for amplifying bias control signals and a DC-DC converter 21 as shown in FIG. 2. The DC-DC converter 21 comprises a pulse oscillator 22, a chopper 23, a transformer 24, a diode bridge 25, and a capacitor 26 as shown in FIG. 1. Copying device 6 comprises an exposure lamp 27 for irradiating document 11*a* as it is scanned for copying through slit 9*b*, a lens 28 for concentrating light reflected from document 11*a*, a rotating photosensitive drum 29, magnetic brush developing device 30, a charger 31, a lamp 32 for eliminating electricity, a cleaning brush 33 and a charger 34 for uniformly charging the photosensitive drum.

Figure 3A:
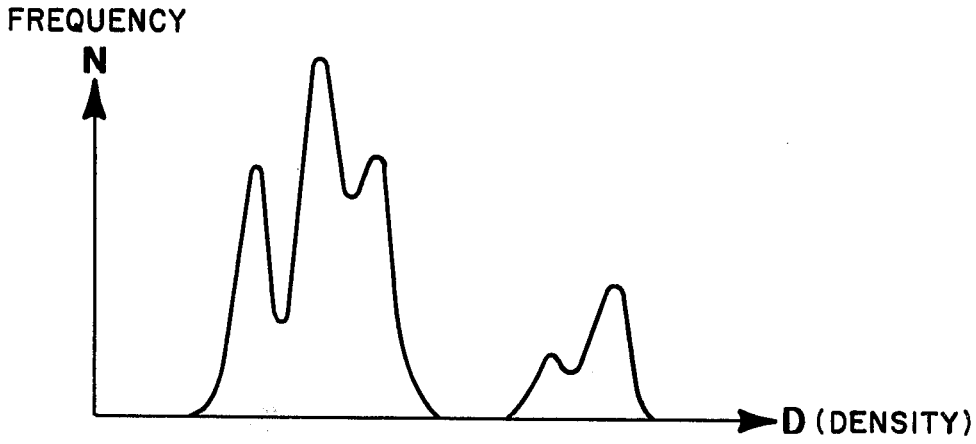
FIGS. 3A, 3B, 3C and 3D show examples of the frequency distribution of the density values in the embodiment shown in FIG. 1.

In operation, document 11*b* is carried in the direction of the arrow by rotation of roller 7*a* and 7*b* in the same direction. Light reflected from document 11*b* through slit 9*a* is converted into electrical reflected signals by photodiode 14 and these electrical signals are amplified in amplifier 15 and supplied to processing circuit 3. The reflected signals are analog signals; an example of the frequency distribution of these signals, in which density is indicated along the x-axis, is shown in FIG. 3A. The density along the scanning line of the document varies in accordance with the tone or color of the document. The frequency of occurrence of these various tones or colors is plotted along the y-axis of FIG. 3A. The analog signals corresponding to the reflected signals are converted into digital signals in analog-digital converter AD and stored at a predetermined sampling rate in a register of the CPU via interface circuit IO.

Figure 3B:
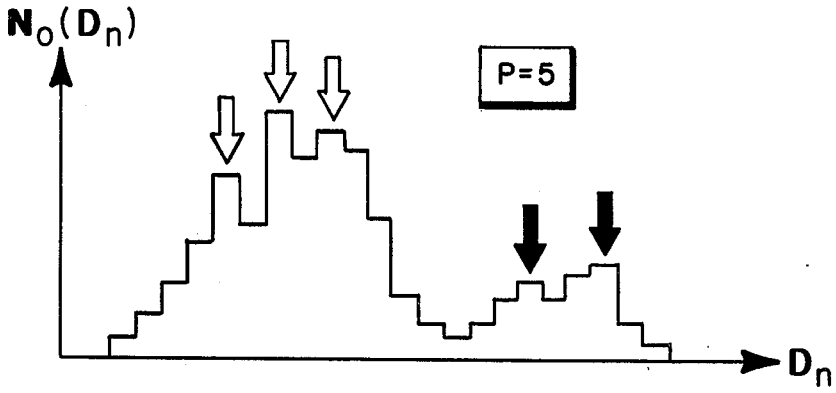

Predetermined density ranges are established as illustrated in FIG. 3B by the various steps corresponding to portions of the curve of FIG. 3A. The CPU counts the frequency of the density at each density range and stores as a frequency distribution in the random access memory RAM. An example of the frequency distribution (histogram) is shown in FIG. 3B. If the address numbers of the random access memory RAM are the same as the density values of the density ranges, then the storage process is simple and can be done at high-speed.

When the preliminary scanning of document 11*b* is finished, as stated above, the frequency distribution of the whole document is obtained as shown in FIG. 3B. The horizontal axis $D_n$ designates the density values divided according to predetermined ranges. The vertical axis No ($D_n$) designates frequency of density $D_n$. The suffix O designates that the frequency distribution has not yet been smoothed.

After the frequency distribution of one whole document is obtained, central processing unit CPU examines the frequency distribution stored in random access memory RAM and counts the number of maximums for peaks in the frequency distribution. In case the number P of maximums is at least three, the smoothing process, which will be explained below, is executed. In case the number P of maximums is one or two, the smoothing process is not executed. For example, for the frequency distribution shown in FIG. 3B, the smoothing process is executed because P=5. The smoothing process is executed repeatedly until the frequency distribution has one or two maximums.

The smoothing process is executed by using a predetermined filter. The binomial distribution of the coefficients of the weighting function are as follows:

$$\frac{Nk(D_0) + N_k(D_1)}{2} \longrightarrow N_{k+1}(D_o)$$

$$\frac{N_k(D_{n-1}) + 2N_k(D_n + N_k(D_{n+1})}{4} \longrightarrow N_{k+1}(_n)\ 2\ n\ m - 2$$

$$\frac{N_k(D_{m-1}) + N_k(D_m)}{2} \longrightarrow N_{k+1}(D_m)$$

Here, $N_k(D_n)$ means the frequency of density $D_n$ after the frequency distribution is smoothed by the smoothing process k times.

Figure 3C:
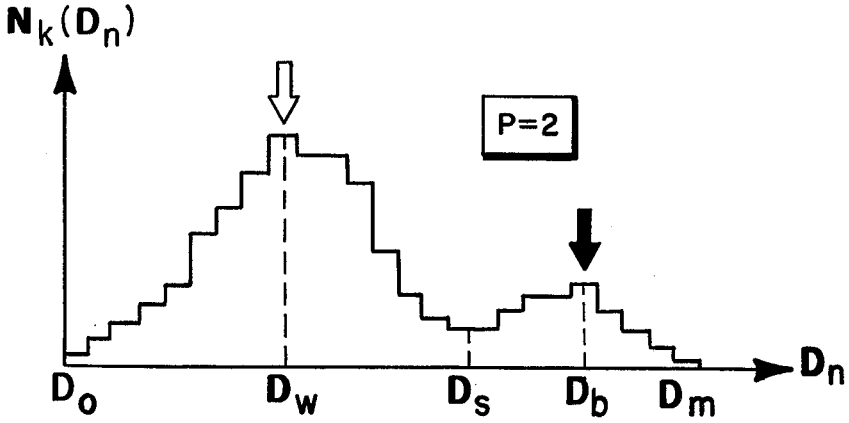

The smoothing process is executed under the control of read only memory ROM1, which stores the above algorithm. The CPU reads out the frequency of each density range stored in the RAM and executes the above calculation and then stores the new data (frequency). When the calculated frequency distribution has one or two maximums, the smoothing process is stopped. FIG. 3*c* shows an example of the frequency distribution after execution of the smoothing process. When P=2, the density value corresponding to one maximum value designates average density value $D_w$ in light parts of the document and the density value corresponding to the other maximum value designates the dark average density value $D_b$. The density value $D_s$ corresponding to the minimum value discriminates between the light density value $D_w$ and the dark density value $D_b$.

Figure 3D:
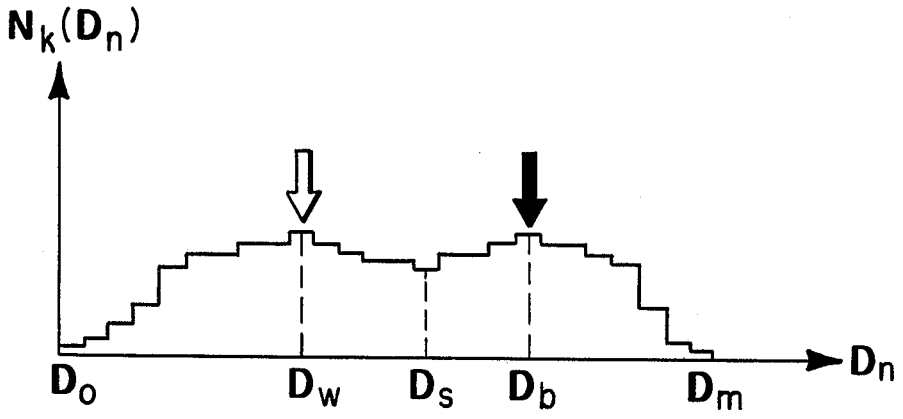

Documents having multi-tone wedges (e.g., photographs) generally have an even frequency distribution in comparison with documents having two tone wedges. For example, the frequency distribution of a document having multi-tone wedges is shown in FIG. 3D. Generally speaking, the larger density differences degrades the quality of copies of documents having multi-tone wedges is less. Therefore, in this embodiment, documents having multi-tone wedges are discriminated from documents having two tone wedges by calculating a variance value about a maximum value (the largest value in case P=1). If the variance is larger than a predetermined value, the document is a document having multi-tone wedges; then, the maximum density value is shifted to lighter side on the density axis. The CPU calculates the variance value by executing an algorithm stored in read only memory ROM1 as follows.

For example, the two types of documents are discriminated by executing the following formula in case of P=2.

$$\sum_{q=o}^{s} \frac{(D_q - D_w)^2 \cdot N(D_q)}{N(D_w)} + \sum_{q=s+1}^{m} \frac{(D_q - D_B)^2 \cdot N(D_q)}{N(D_B)}$$

In the event of P=1, the documents are discriminated by executing the following formula.

$$\sum_{q=o}^{m} \frac{(D_q - D_w) \cdot N(D_q)}{N(D_w)}$$

Namely, the density value corresponding to the largest value is presumed to be the light density value $D_w$ in case of P=1 and then the variance value is calculated.

When the variance is larger than the predetermined value which is experientially obtained, the copied document is decided a document having multi-tone wedges.

On the other hand, when the variance value is smaller than the predetermined value, the document is a document having two tone wedges. If the document is a document having multitone wedges, the white (light) level density value $D_w$ and black (dark) level density value $D_b$ obtained from the frequency distribution are changed to the values $D'_w$ and $D'_b$ which are smaller than $D_w$ and $D_b$. The process for changing these values is a parallel shift which results in less exposure time. As a result, copying images having high quality are obtained for multi-tone documents.

As stated above, in the copying apparatus, the frequency distribution first is obtained and the number of maxima P is counted. When the number P is at least 3, the smoothing process is repeatedly executed till the number P is one or two. When P=2, the white level density value $D_w$ and the black level density value $D_b$ are determined. When P=1, the apparent white level density value $D_w$ is detected. Of course, in the case of multi-tone documents, $D'_w$ and $D'_b$, or $D'_w$ are obtained.

The off time $t_c$ determines the appropriate exposure time $L^c$ in accordance with the white level density value $D_w(D'_w)$ and the black level density value $D_b(D'_b)$. The bias voltage $V_{bc}$ is the bias voltage supplied to magnetic brush developing device 30; this bias voltage is a function of the white level density value $D_w(D'_w)$ and the black level density value $(D_b(D'_b)$. The off time $t_c$ and the bias voltage $V_{bc}$ are stored in read only memory ROM2. Therefore, when the white level density value $D_w(D'_w)$ and the black level density $D_b(D'_b)$ obtained by the CPU are supplied to read only memory ROM2, the appropriate off time $t_c$ and bias voltage value $V_{bc}$ are read out and supplied to exposure control device 4 and bias control device 5 through interface circuit IO.

Figure 4:
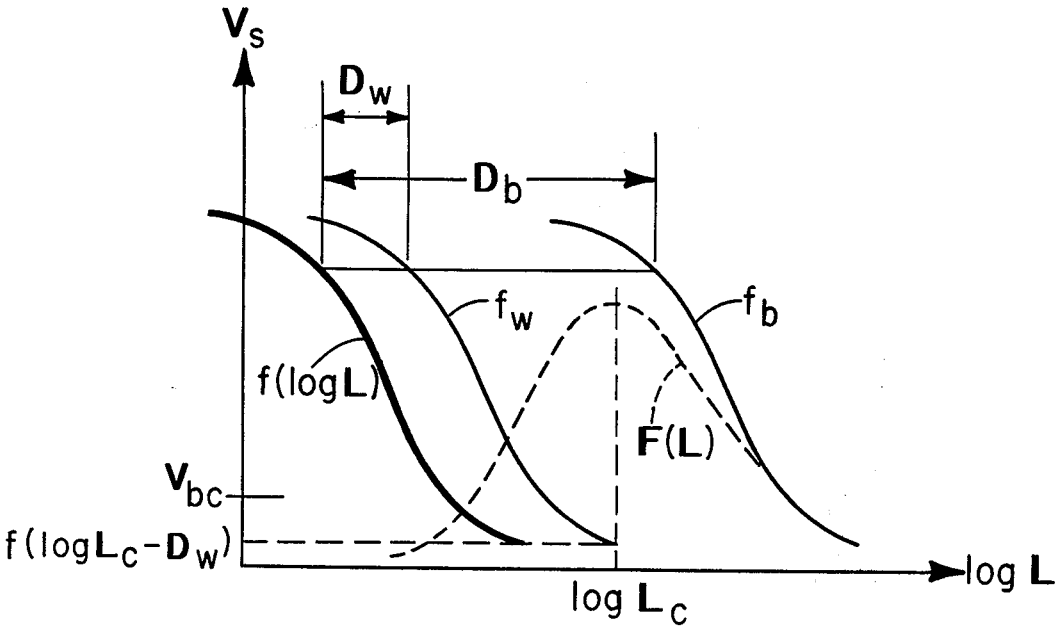
FIG. 4 shows the logarithmic relationship between the exposure time and the surface potential of the photosensitive material.

The relationship exists between the appropriate off time $t_c$ (or appropriate bias value $V_{bc}$), the white level density value $D_w(D'_w)$ and the black level density value $D_b(D'_b)$. At first, the case of P=2 will be explained with reference to FIG. 4. The thick line in FIG. 4 shows generally the logarithmic relationship between exposure time on photosensitive drum 29 (log L) and the surface voltage $V_s$ on photosensitive drum 29. Namely, when the exposure time L increases, the conductivity of photosensitive material increases and the surface potential gradually lowers. The characteristic curve is described by f=f(log L). Additional characteristic curves in which f=f(log L) is shifted above white level density value $D_w$ and black level density value $D_b$ in a direction along the log L axis can be designated $f_w=f(\log L-Dw)$ and $f_b=f(\log L-D_b)$ as shown by the thin lines in FIG. 4. These characteristics curves $f_w$ and $f_b$ represent surface voltages on photosensitive drum 29 according to the white level density value $D_w$ and the black level density value $D_b$. When the difference between these characteristic curves (i.e., $f_b-f_w$) is designated by F(L), yet another characteristic curve represents the differential voltage between the light part and the dark part versus exposure time. The characteristic curve F(L), which is shown by a dotted line in FIG. 4, can be expressed as follows.

$$F(L)=f(\log L-D_b)-f(\log L-D_w)$$

If the maximum exposure time of F(L) is designated by $L_c$, $F(L)\leqq F(L_c)$, when the exposure time $L_c$ occurs on the surface of the photosensitive drum 29, the differential quantity of developing toner is large and the range of intermediate tone is large. Namely, the $L_c$ represents the most appropriate exposure time. When $L_c$ is obtained as stated above, the most appropriate bias voltage $V_{bc}$ can be obtained by the following formula:

$$V_{bc}\geqq f(\log L_c-D_w)+C$$

Here, the constant C may be about 50 volts. As stated, the most appropriate exposure time $L_c$ and the most appropriate bias voltage $V_{bc}$ are obtained according to the white level density $D_w$ and the black level density $D_b$ in the case of P=2.

In addition, $L_c$ and $V_{bc}$ can be obtained as follows in the case of P=1. In this case, the density value considered is the white level density $D_w$. Then, $L_c$ and $V_{bc}$ can be determined by the formula:

$$V_{bc}=f(\log L_c-D_w)+100 \text{ (volts)}$$

In the case of P=1, either $L_c$ or $V_{bc}$ can be determined beforehand.

The exposure time $L_c$ is controlled by phase control of the a.c. voltage supplied to exposure lamp 27. Exposure time L is changed by off time $t_c$ of bidirectional thyristor 17. The off time $t_c$ is set so that exposure time L becomes the most appropriate exposure time. The relationship between $L_c$ and $t_c$ can be theoretically determined by using the temperature characteristic of resistivity of tungsten, the relation between off time of an a.c. source and supplied power, Stefan-Boltzmann's law of radiation, Plank's formula of radiation and the spectrosensitive characteristic of photosensitive material. If the frequency of an a.c. source is 50 Hz, and the variable range of off time is from zero-cross time to 5 ms, the formula for off time $t_c$ is obtained as follows.

$$t_c=\frac{1}{2}\left\{1+\sqrt{161-160\left(\frac{L_c}{L_o}\right)^n}\right\}$$

In the above formula, the trigonometric function is substituted by an appropriate two order formula and $L_o$ represents the exposure time when all power is supplied. When the color temperature of an 800 Watt exposure lamp and the spectrosensitive condition of selenium photosensitive material are included in the above formula, n is 0.59.

Figure 5:
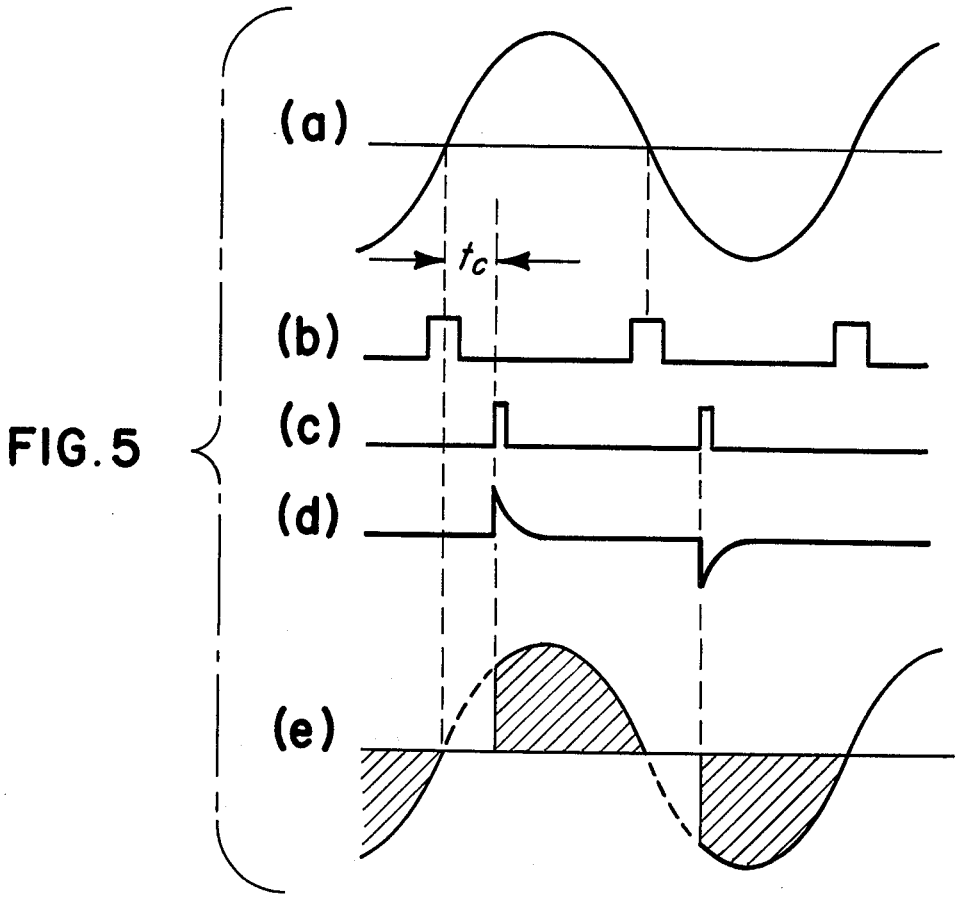
FIG. 5 shows how to control off time of a bidirectional thyristor.

The control of exposure time will now be explained with reference to FIGS. 1 and 5. FIG. 5(*a*) shows output waveforms of a.c. power source 18. The signals are supplied to zero-crossing detector 19 resulting in the zero-crossing pulse series shown in FIG. 5(*b*). The zero-crossing pulse series is supplied to processing circuit 3; the pulse series is delayed by $t_c$ as shown in FIG. 5(*c*). The delayed pulse series is changed into trigger pulses as shown in FIG. 5(*d*) by trigger pulse circuit 16. The trigger pulses are supplied to bidirectional thyristor 17 and then the a.c. voltage shown in FIG. 5(*e*) is supplied to exposure lamp 27. Exposure occurs during the time indicated by oblique lines in FIG. 5(*e*).

On the other hand, the most appropriate bias voltage $V_{bc}$ supplied to magnetic brush developing device 30 is controlled as follows. The most appropriate bias voltage digital value $V_{bc}$ read out from read only memory ROM2 as stated above is latched in interface circuit IO and converted to an analog value in digital-analog converter DA. The analog voltage is amplified in amplifier 20 and converted into a high voltage in the conventional DC-DC converter 21. The high voltage is supplied to magnetic brush developing device 30.

After the exposure time and the bias voltage are established, the document moves as shown by 11*a* in FIG. 1. The document 11*a* is irradiated by exposure lamp 27 through slit 9*b* and the light reflected from the document is concentrated by lens 28 and focused on the surface of photosensitive drum 29. The photosensitive drum 29 is uniformly charged by charger 34. Therefore, a latent image is formed on drum 29 corresponding to document 11*a* by image exposure (i.e. the light irradiation on drum 29). Next, the latent image is developed by toner particles in magnetic brush developing device 30. The developed image is transferred onto paper by charger 31 and fixed by a fixing device (not shown). The surface of photosensitive drum 29 then is irradiated by lamp 32 to erase the latent image. Thereafter, residual toners are eliminated by cleaning brush 33 and the process of uniform charging of the photosensitive drum begins again. As stated above, as the bias voltage of magnetic brush developing device 30 is established according to the density of the document, good image copies are always obtained.

The above embodiment has several advantages. Since both the exposure time and the developing bias voltage are adjusted according to the frequency distribution of the density, copies having much high quality can be obtained. Also, good copies are obtained in the case of multi-tone documents because multi-tone documents and two tone documents are discriminated and the control of exposure time and the developing bias voltage is according to the kind of document being copied.

In FIG. 1, a lamp 12 and lens 13 are used in addition to exposure lamp 27. However, it is possible to use one lamp for both functions. This latter embodiment will be explained with reference to FIGS. 6 and 7. A document 71 is moved on a supporting member 72 and irradiated by an exposure lamp 73. The light reflected from document 71 is concentrated and focused on the surface of photosensitive drum 75. The drum 75 is uniformly charged by a charger 76, so a latent image is formed by the image exposure. The latent image is developed by a magnetic brush developing device 77 and then transferred onto paper 79 by a charger 78. The latent image is erased by a lamp 80 and residual toners are eliminated by cleaning brush 81.

The reflected light from document 71 is also received by a photodiode 82 and the analog electrical signals generated from photodiode 82 are amplified in an amplifier 83. Thereafter, these signals are converted to digital signals in an analog-digital converter 84 and the digital signals are supplied into a processing circuit 85.

Exposure lamp 73 is activated via a.c. power source 86 and a bidirectional thyrister 87. The thyristor 87 is on and off by trigger pulses from a trigger pulse circuit 88. The output of a.c. power source 86 is converted into a pulse series in zero-crossing detector 89 and the pulse series is supplied to processing circuit 85. The exposure time of exposure lamp 73 is controlled by changing the delay time of delay pulses supplied to trigger circuit 88 relative to the pulse series. At first, the off time of bidirectional thyristor 87 is determined and the pulses series is obtained from zero-crossing detector 89. Next, trigger pulse circuit 88 supplies delay pulses having delay time corresponding to the above off time to bidirectional thyristor 87 under control of processing circuit 85. Next, the reflecting signals detected by photodiode 82 are converted into digital signals by analog-digital converter 84 are supplied into processing circuit 85. When the trigger pulses (delayed pulses) supplied to bidirectional thyristor 87 are determined, the exposure time of exposure lamp 73 is determined. Changes in the reflecting signals detected by photodiode 82 represent changes in density which results in an adjustment of exposure time.

Next, the frequency of each density range is counted and stored as described in the first embodiment. Frequency distribution is obtained at each scanning though exposure time is determined after scanning the whole document. The number P of maximum values in each frequency distribution is determined. In the case of $P=3$, the smoothing process is executed till $P=2$. The frequency distribution is stored in processing circuit 85 and the number P is determined in processing circuit 85. In the case of $P=2$, the harmonic mean of two density values according to two maximum values $D_w$ and $D_b$ is calculated. In this embodiment, the most appropriate exposure time is determined in accordance with one harmonic value, not two density values, for the reasons expressed below.

Figure 6:
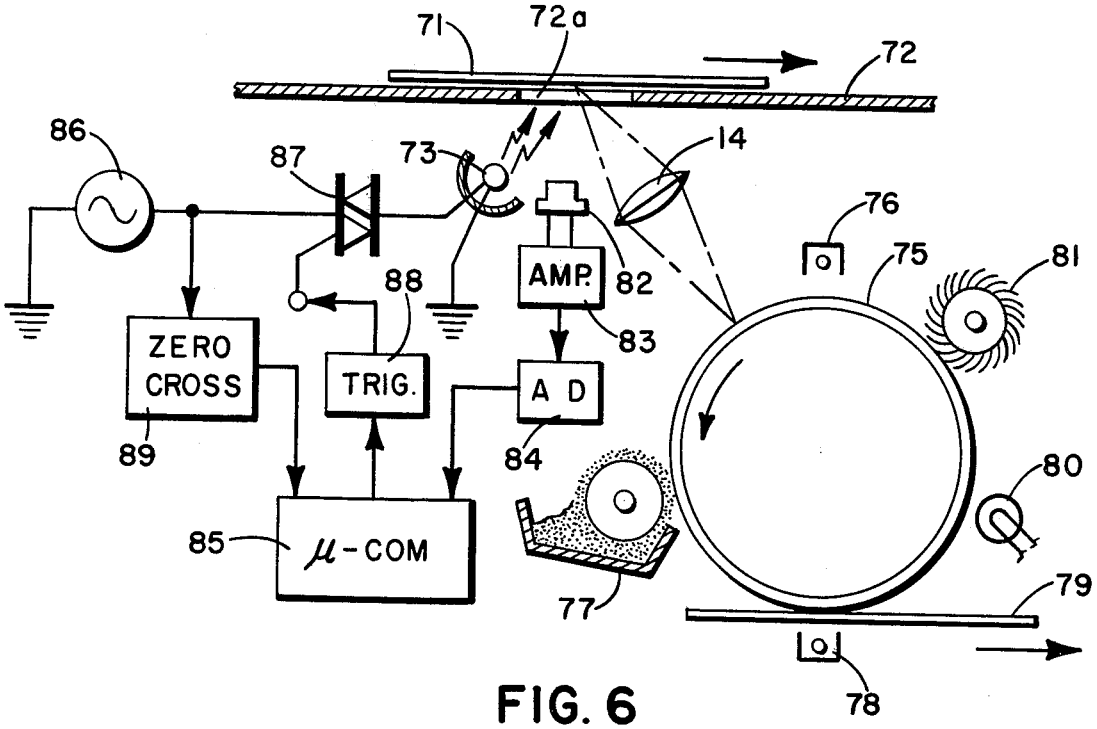
FIG. 6 shows a schematic view of another embodiment of the invention.

The embodiment shown in FIG. 6 does not have a lens (optical focusing system) associated with photodiode 82 as shown in the embodiment of FIG. 1. In the embodiment of FIG. 1, frequency distributions having small maxima sometimes occur and mean density values of dark portions and light portions are sometimes detected when the resolution is low. In apparatus having low resolution, two density values to two maximum values cannot be regarded as the true white level density and true black density values.

In order to control exposure time from density information obtained by detecting systems having low resolution, the following conditions must be satisfied:

(1) Information about the density of the document must be obtained which does not upon the resolution of the optical detecting system and the copy image.

(2) Information about the density of the document must be obtained which has a continuously increasing or decreasing relationship to the most appropriate control quantity.

In the present invention it was discovered, that the harmonic mean value most nearly satisfies the above two conditions.

Figure 7:
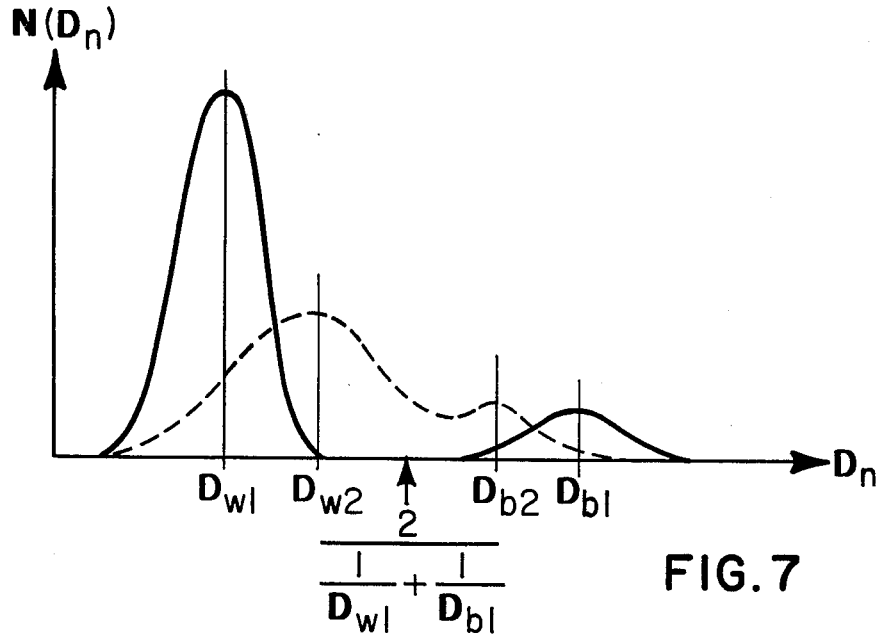
FIG. 7 shows a density frequency distribution used to explain harmonic mean values of two density values.

For example, if the frequency distribution corresponding to the solid line in FIG. 7 is obtained by a light quantity detecting system having high resolution, the frequency distribution shown in the dotted line in FIG. 7 will be obtained by a system having low resolution. If $D_{w1}$ and $D_{b1}$ represent the white level density and the black level density corresponding to two maxima of the high resolution frequency distribution and $D_{w2}$ and $D_{b2}$ represent the white level density and the black level density corresponding to two maxima of the low resolution frequency distribution, the harmonic mean values in both are approximately the same. Namely, this is shown by the following formula:

$$\frac{2}{\frac{1}{D_{w1}}+\frac{1}{D_{B1}}} \cong \frac{2}{\frac{1}{D_{w2}}+\frac{1}{D_{B2}}}$$

Thus, a harmonic mean value satisfies the first of the above conditions. In the above formula, in the case of $D_w=D_b$, i.e., when $P=1$, the most appropriate control quantity can be obtained by considering the density value corresponding to the one maximum value as the harmonic mean value.

Figure 8A:
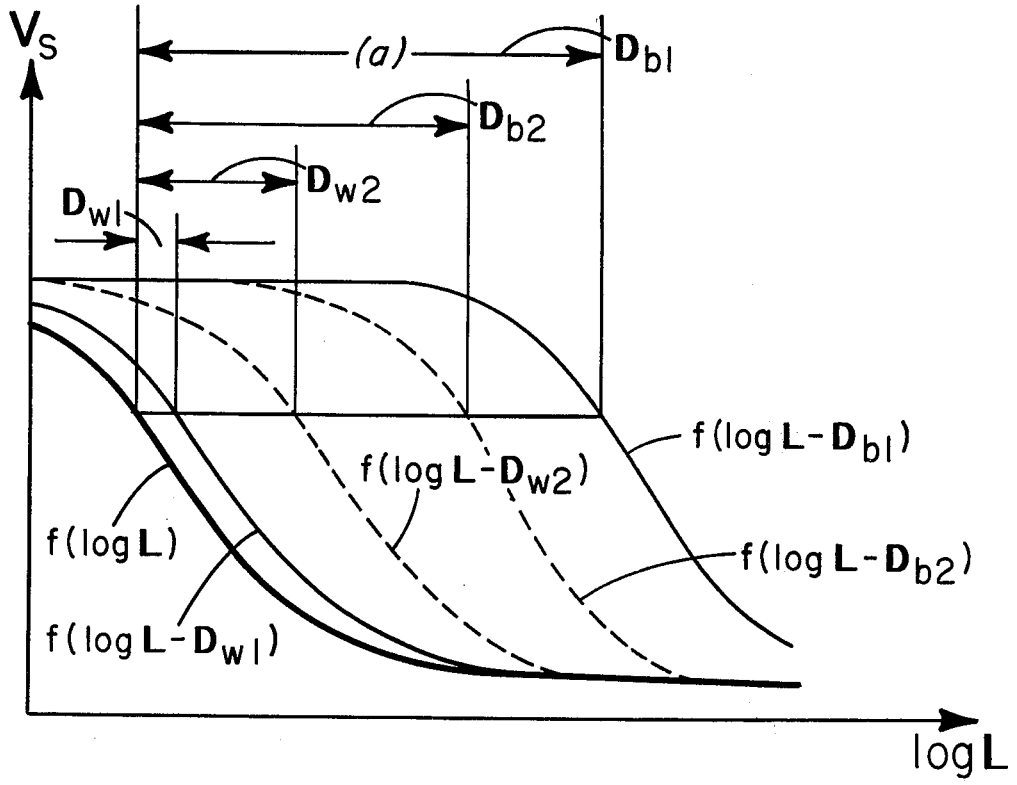
FIG. 8 shows the logarithmic relationship between exposure time and the surface potential.

Also, because the relationship between the surface potential of the photosensitive material and the exposure time the harmonic mean value satisfies the second of the above conditions. A bold line shown in FIG. 8A represents the logarithmic relationship between the exposure time and the surface potential of the photosensitive material (i.e. f(log L)). The two fine lines represent the characteristic curves parallel to the curve f(log L), i.e. f(log $L-D_{w1}$) and f(log $L-D_{b1}$). The two dotted lines represent two other characteristic curves parallel to f(log L), i.e. f(log $L-D_{w2}$) and f(log $L-D_{b2}$). The function F (the contrast function) can be obtained from the above characteristics as shown in FIG. 8B. The function $F_1$ (solid line) shows the contrast function obtained by the white level density $D_{w1}$ and the black level density $D_{b1}$, i.e. f(log $L-D_{b1}$)−f(log $L-D_{w1}$). The function $F_2$ (dotted line) shows the contrast function obtained by the white level density $D_{w2}$ and the black level density $D_{b2}$, i.e. f(log $L-D_{b2}$)−f(log $L-D_{w2}$). As clear in FIG. 8B, each of the contrast functions $F_1$ and $F_2$ has a maximum value at the same exposure value $L_c$ (i.e., the most appropriate exposure time). In other words, if a harmonic mean value is used, the most appropriate exposure time $L_c$ can be obtained regardless of the resolution of the system. Also, it is clear that the most appropriate exposure time $L_c$ has a continuously increasing relationship to the harmonic mean value.

When the frequency distribution has one or two maxima, whether smoothing is performed or not, the density value according to the maximum value is obtained in the case of $P=1$ and the harmonic mean value of the two density values according to the two maximum values in the case of $P=2$.Thus, the control quantity (e.g., exposure time) corresponding to the one density value is obtained.

The most appropriate off time $t_c$ can be obtained as discussed in the first embodiment. The relationship between the harmonic means value and the off time $t_c$ is stored is read only memory ROM of processing circuit 85 and the frequency distributions of density are obtained. The harmonic mean value or one density value then is read out from the memory. In this embodiment, the most appropriate exposure time is determined considering a predetermined developing bias voltage.

The embodiment of this invention shown in FIG. 6 has several advantages. The lamp 73 is used both as a lamp for detecting density and the light source for reproduction of the document. Since the lens system for receiving element (i.e., photodiode 82) is not necessary, the structure of the copying apparatus is simple. Finally, as only exposure time is controlled by one density value, it is possible to simplify the electrical circuit.

In the above embodiment, the most appropriate control is based on the density value corresponding to the maximum value of the frequency distribution. However, it is possible to control exposure time etc. based on the density value corresponding to the minimum value. For example, the value $D_s$ shown in FIG. 3C might be used as the threshold level to discriminate white density and black density and control the exposure time etc. to thereby shorten the process.

In the above embodiment, quality control is determined by the differential density between light parts and dark parts which is the greatest in the case of a two tone document. However, it is also possible to control quality such that the light parts do not become dark. For example, in the latter case, only the white level density $D_w$ is used even if both $D_w$ and $D_b$ are obtained.

Obviously, many modifications and variations of this invention are possible in light of the above teachings. It is therefore to be understood that, within the scope of the appended claims, this invention may be practiced otherwise than as specifically described. For example, the invention can be applied not only to apparatus for copying documents on hand but also to apparatus for reproducing documents far away, i.e. facsimile apparatus.

I claim:

1. An automatic quality control copying apparatus comprising:

frequency detecting means for detecting the frequency distribution of the density of a document, the frequency distribution meaning the frequency of occurrence of each density value of the document;

smoothing means for smoothing the frequency distribution when the frequency distribution has at least three maxima, said smoothing means executing a predetermined filter function till the frequency distribution has one or two maxima;

density detecting means responsive to said frequency detecting means and said smoothing means for detecting at least one density value according to a maximum or minimum value of the frequency distribution when the frequency distribution has one or two maxima; and control means for controlling the quality of a reproductive image according to the detected density value.

2. An automatic quality control copying apparatus according to claim 1 wherein said density detecting means detects two density values corresponding to two maximum values when the frequency distribution has two maxima.

3. An automatic quality control copying apparatus according to claim 2 wherein said density detecting means calculates the harmonic mean of the two density values.

4. An automatic picture control copying apparatus according to claim 1 wherein said smoothing means smooths the frequency distribution by using a weighting function having binomial distribution coefficients.

5. An automatic quality control copying apparatus according to claim 1 further comprising a first lamp to expose a photosensitive material and said control means controls the exposure time of said first lamp according to the density value.

6. An automatic quality control copying apparatus according to claim 1 further comprising a developing device to develop a latent image formed on a photosensitive material and said control means controls a voltage value supplied to said developing device according to the density value.

7. An automatic quality control copying apparatus according to claim 5 wherein said control means controls the exposure time by phase control of an a.c. voltage supplied to said first lamp.

8. An automatic quality control copying apparatus according to claim 5 wherein said frequency detecting means comprises a second lamp, said frequency detecting means detecting the frequency distribution of each document before copying by using said second lamp.

9. An automatic quality control copying apparatus according to claim 5 wherein said frequency detecting means stores the frequency of each density value in order by using said first lamp and detects the frequency distribution before copying.

10. An automatic quality control copying apparatus comprising:

frequency detecting means for detecting the frequency distribution of the density of a document, the frequency distribution meaning the frequency of occurrence of each density value of the document;

smoothing means for smoothing the frequency distribution when the frequency distribution has at least three maxima, said smoothing means executing a predetermined filter function till the frequency distribution has one or two maxima;

variance calculating means for calculating a variance value about a maximum value in the frequency distribution have one or two maxima;

density detecting means responsive to said frequency detecting means and said smoothing means for detecting at least one density value according to a maximum or minimum value of the frequency distribution when the frequency distribution has one or two maxima; and control means for controlling the quality of a reproductive image according to the detected density value and the variance value.

11. An automatic quality control copying apparatus according to claim 10 wherein said density detecting means detects two density values according to two maximum values when the frequency distribution has two maxima.

12. An automatic quality control copying apparatus according to claim 10 wherein said density detecting means further calculates the harmonic mean value of the two density values.

13. An automatic quality control copying apparatus according to claim 10 wherein said smoothing means smoothes the frequency distribution by using a weighting function having binominal distribution coefficients.

14. An automatic quality control copying apparatus according the claim 10 further comprising a first lamp to expose a photosensitive material and said control means controls the exposure time of said first lamp according to the density value.

15. An automatic quality control copying apparatus according to claim 14 further comprising a developing device to develop a latent image formed on a photosensitive material and said control means and controls a voltage value supplied to said developing device according to the density value.

16. An automatic quality control copying apparatus according to claim 14 wherein said control means controls the exposure time by phase control of an a.c. voltage supplied to said first lamp.

17. An automatic quality control copying apparatus according to claim 14 wherein said frequency detecting means comprises a second lamp, said frequency detecting means detecting the frequency distribution of each document before copying by using said second lamp.

18. An automatic quality control copying apparatus according to claim 14 wherein said frequency detecting means stores the frequency of each density value in order by using said first lamp and detects the frequency distribution before copying.

* * * * *